US005375187A

United States Patent [19]

Ibsen et al.

[11] Patent Number: 5,375,187

[45] Date of Patent: Dec. 20, 1994

[54] METHOD AND APPARATUS FOR HEAT CURING RESIN COMPOUNDS

[75] Inventors: Robert L. Ibsen, Santa Maria; Thomas C. Chadwick, Nipomo; David F. Ouellet, Santa Maria, all of Calif.

[73] Assignee: Den-Mat Corporation, Santa Maria, Calif.

[21] Appl. No.: 16,905

[22] Filed: Feb. 12, 1993

[51] Int. Cl.[5] ..... F27B 5/14

[52] U.S. Cl. ..... 392/416; 219/390

[58] Field of Search ..... 392/416, 418; 219/390

[56] References Cited

U.S. PATENT DOCUMENTS

| | | | |
|---|---|---|---|
| 787,584 | 4/1905 | Matteson | 219/390 |
| 1,415,770 | 5/1922 | Berry | 392/418 |
| 1,659,278 | 2/1928 | Meltzer | 392/418 |
| 1,805,291 | 5/1931 | Monnot | 392/418 |
| 2,210,483 | 8/1940 | Feron | 219/390 |
| 2,720,580 | 10/1955 | Kraut | 392/416 |

FOREIGN PATENT DOCUMENTS

| | | | |
|---|---|---|---|
| 742180 | 12/1955 | United Kingdom | 219/390 |

*Primary Examiner*—Teresa J. Walberg
*Attorney, Agent, or Firm*—Spensley Horn Jubas & Lubitz

[57] ABSTRACT

A method and apparatus for heat-curing light-cured resins by means of placing the resin in an oven attachment coupled to a high intensity light source, such that heat generated by the light source raises the temperature within the oven attachment to at least 140° C., and maintains the temperature above 140° C. for at least 10 minutes. The oven attachment has a body fabricated from a rigid material having a relatively low thermal conductivity. The oven attachment is fashioned to fit over the light outlet of a conventional light source. The oven attachment is preferably held in place by the same mechanism that holds a light-curing "wand" to the light source. The light source is turned on for a heating period of approximately 15 minutes, causing the temperature within an oven chamber within the oven attachment to rise. Upon completion of the heating period, the light source is turned off and the heat-cured restoration may be removed.

12 Claims, 2 Drawing Sheets

METHOD AND APPARATUS FOR HEAT CURING RESIN COMPOUNDS

BACKGROUND OF THE INVENTION

1. Field of the Invention

This invention relates to a method and apparatus for curing resin compounds, and more particularly to a method and apparatus for heat-curing resin compounds that have been previously light-cured.

2. Description of Related Art

It is well known to use high intensity visible and ultra-violet light to cure resin compounds used to fabricate dental restorations, such as crowns, bridges, or laminates. Light sources, such as the Marathon Two Visible Light-Curing Unit, manufactured and distributed by Den-Mat Corporation, are well known to be used for the purpose of light-curing such resin compounds. Typically, a light "wand" is attached to the light source and transmits a high intensity light beam from the source to a resin compound dental restoration. The user points the wand at the dental restoration and causes the high intensity light emitted therefrom to illuminate the dental restoration for a period of approximately one minute, thereby light-curing the resin compound.

It is also known that the compressive strength of certain resins which have been light-cured can be further enhanced by heat-curing after light-curing. For example, one resin compound, known as PERFECTION TM, which is commonly used to fabricate dental restorations, has been tested to have an increase in compressive strength from 19,800 psi to 33,100 psi when subjected to temperatures between 140°-160° C. for approximately 15 minutes.

Dedicated ovens having integral heating elements which are capable of generating temperatures required to heat-cure resin compounds for the purpose of enhancing the compressive strength of a light-cured resin compound are relatively expensive. Further, such dedicated ovens are in addition to the apparatus which is required for light-curing. Therefore, it would be desirable to have an inexpensive means for heat-curing resin compounds which does not require the purchase of a relatively expensive dedicated oven.

SUMMARY OF THE INVENTION

The present invention is a method and apparatus for heat-curing light-cured resins by means of placing the resin in an oven attachment coupled to a high intensity light source, such that heat generated by the light source raises the temperature within the oven attachment to at least 140° C., and maintains the temperature above 140° C. for at least 10 minutes.

The oven attachment has a body fabricated from a rigid material having a relatively low thermal conductivity and capable of being easily molded, cut, milled, and otherwise shaped. The oven attachment is fashioned to fit over the light outlet of a conventional light source, such as the Marathon Two Visible Light-Curing Unit, manufactured and distributed by Den-Mat Corporation. The oven attachment is preferably held in place by the same mechanism that holds a light-curing "wand" to the light source. The oven attachment preferably has a cylindrical oven chamber into which a dental restoration or other structure made from a light-curable, heat-curable resin compound is placed. The light source is turned on for a heating period of approximately 15 minutes, causing the temperature within the oven chamber to rise. Upon completion of the heating period, the light source is turned off and the heat-cured restoration may be removed.

The details of the preferred embodiment of the present invention are set forth in the accompanying drawings and the description below. Once the details of the invention are known, numerous additional innovations and changes will become obvious to one skilled in the art.

BRIEF DESCRIPTION OF THE DRAWINGS

Like reference numbers and designations in the various drawings refer to like elements.

DETAILED DESCRIPTION OF THE INVENTION

Figure 1:
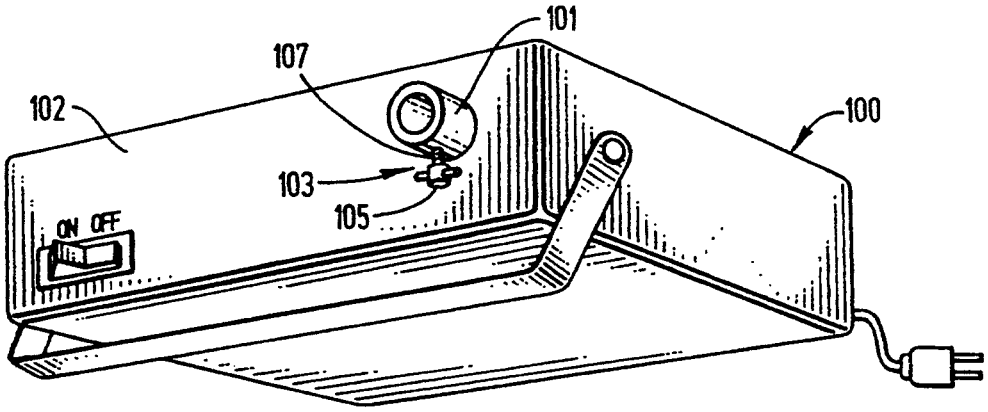
FIG. 1 PRIOR ART
FIG. 1 is a perspective view of a prior art light source with a light outlet extending from a control panel.

Throughout this description, the preferred embodiment and examples shown should be considered as exemplars, rather than as limitations on the present invention. FIG. 1 is a front perspective view of a prior art light source 100, such as the Marathon Two Visible Light-Curing Unit manufactured and distributed by Den-Mat Corporation. The prior art light source 100 includes a light outlet 101 on a control panel 102 of the light source 100. The light outlet 101 is a hollow cylindrical boss extending from the control panel 102. At the bottom of the light outlet 101, a thumb screw 103 is threaded into the light outlet 101 for securing a light wand (not shown) to the light source 100. The head 105 and a portion of the shaft 107 of the thumb screw 103 extend from the light outlet 101.

Figure 2A:
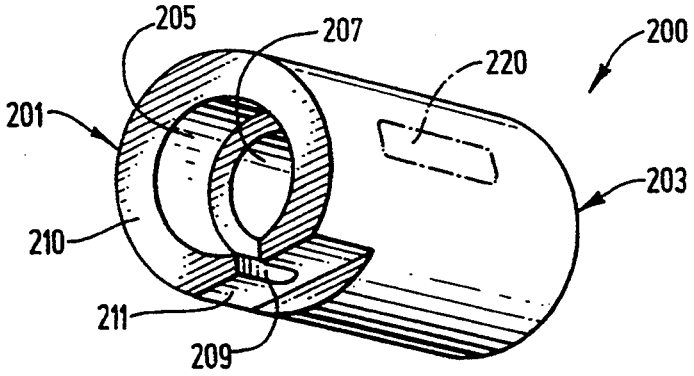
FIG. 2*a* is perspective view of the present invention.
Figure 2B:
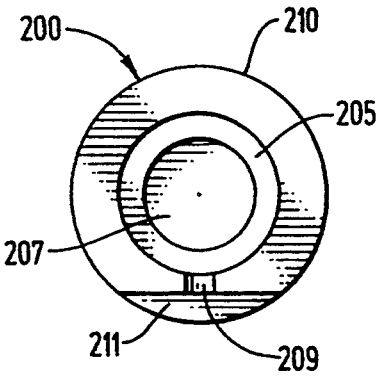
FIG. 2*b* is a front plan view of the present invention.
Figure 2C:
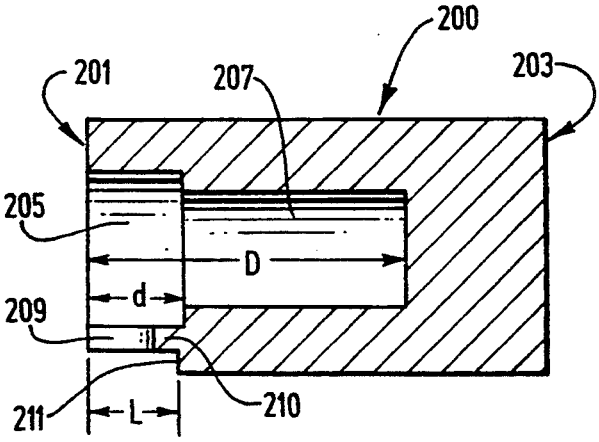
FIG. 2*c* is a side cross-sectional view of the present invention.

FIG. 2*a* is a perspective view of a resin compound oven attachment 200 in accordance with the present invention. FIG. 2*b* is a front plan view of the oven attachment 200, and FIG. 2*c* is a side cross-sectional view of the oven attachment 200. The oven attachment 200 in the illustrated embodiment has a generally cylindrical body which is open at a proximal end 201 and closed at a distal end 203. The proximal end 201 is open to a mating bore 205 and a heat chamber 207. In the illustrated embodiment, the mating bore 205 has a diameter that is greater than the diameter of the heat chamber 207 and is adapted to fit over the light outlet 101 of the light source 1 00. In the illustrated embodiment of the present invention, the diameter of the heat chamber 207 is approximately 0.625 inches. The illustrated heat chamber 207 has a depth D that is greater than the depth d of the mating bore 205, and is configured to have sufficient volume to receive a resin-compound dental restoration. The depth of the illustrated heat chamber is approximately 1.25 inches. To adapt the particular oven attachment 200 to the particular light source 100 shown in FIG. 3, a slot 209 is cut through a wall 210 at the proximal end 201 of the oven attachment 200 to a depth that is less than d. At the proximal end 201 of the oven attachment 200, centered on the slot 209, a notch 211 is cut into the outside diameter of the oven attachment leaving a portion of the outside diameter flat for a longitudinal distance /.

Figure 3:
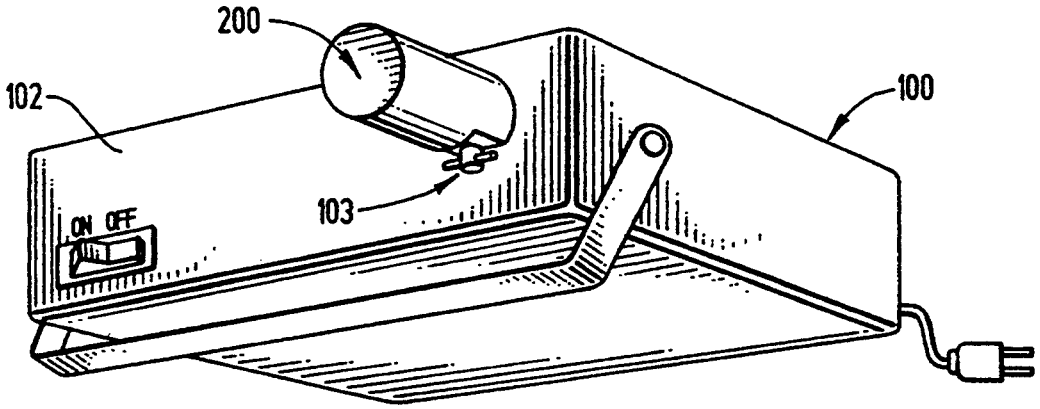
FIG. 3 is a perspective view of the present invention mated with a prior art light source.

As shown in FIG. 3, when the illustrated oven attachment 200 is mated with the light outlet 101, the shaft 107 of the thumb screw 103 enters the slot 209 in the oven attachment 200. The slot 209 is sufficiently deep to allow the proximal end 201 of the oven attachment 200 to mate flush with the control panel 102 of the light source 100. The head 105 of the thumb screw 103 slides into the notch 211, such that an operator may tighten the thumb screw 103 by rotating the head 105. Rotating the head 105 causes the head 105 to come into contact with the flattened portion of the outer wall 210 of the oven attachment 200 formed by the notch 211. The thumb screw 103, when tightened, applies a compressive force to the portion of the wall 210 that lies between the head 105 of the thumb screw 103 and the light outlet 101, thus affixing the oven attachment to the light outlet 101.

Figure 4:
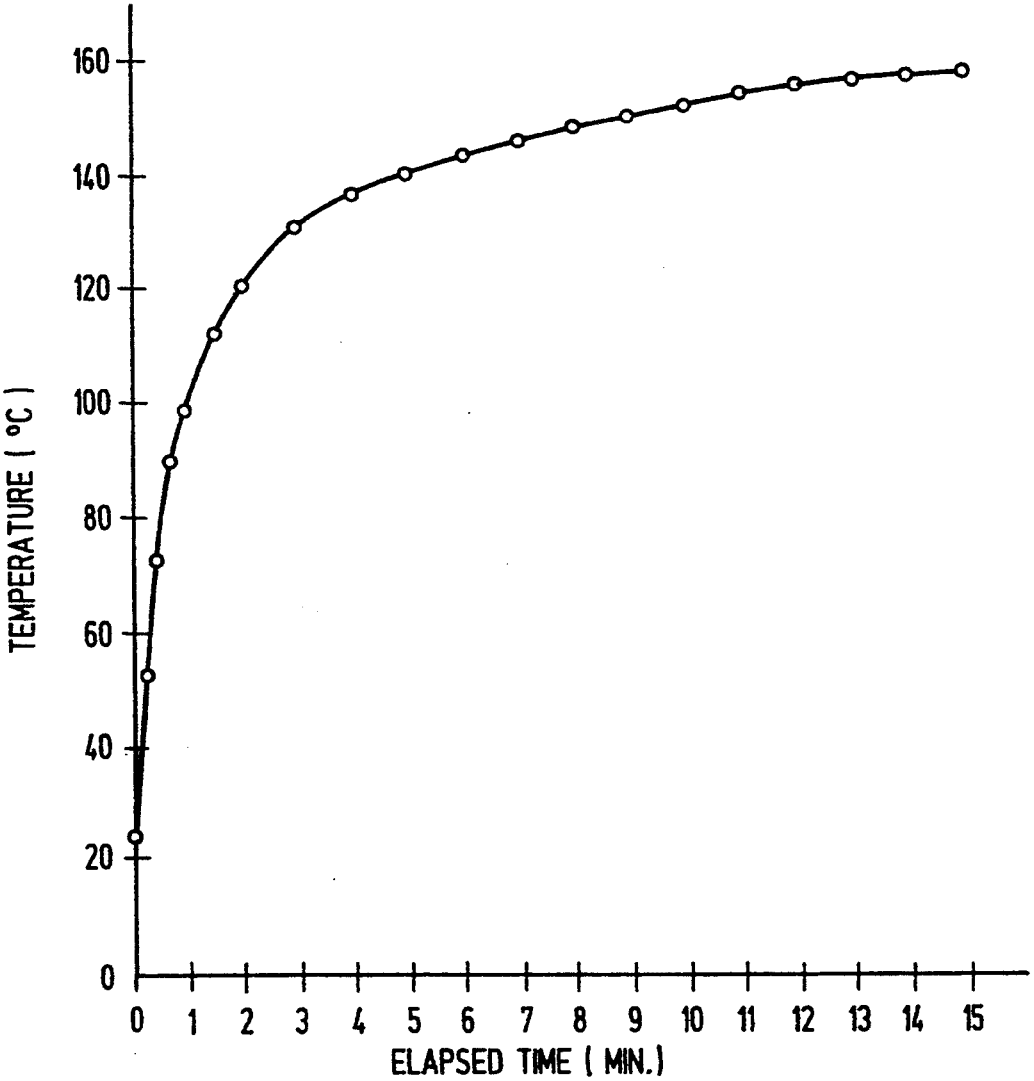
FIG. 4 is a graph of the temperature vs. time within the oven chamber of an inventive oven attachment.

A structure, such as a dental restoration, formed from a light-cured resin compound, such as light-cured PERFECTION TM, is placed into the heat chamber 207 of the oven attachment 200. The oven attachment 200 is then mated with a light source 100, as described above. The light source 100 is turned on, such that high intensity light illuminates the heat chamber 207, causing the temperature in the insulated heat chamber 207 to rise. FIG. 4 illustrates the temperature rise curve measured inside the illustrated embodiment of the present invention. Allowing the restoration to remain in the heat chamber 207 for approximately 15 minutes provides the desired heat-curing effect on the resin compound.

In an alternative embodiment of the present invention, a thermometer 220, such as a liquid crystal thermometer, is attached to the oven attachment 200, so as to be visible from the outside of the oven attachment 200 to indicate the temperature within the oven attachment 200. Such a thermometer may be calibrated in known fashion. Also, additional insulating material may be applied to the outside of the wall 210 of the oven attachment 200, or to a handle or other similar structure attached to the oven attachment 200, to prevent a user from being burned when coming in contact with the wall 210.

A number of embodiments of the present invention have been described. Nevertheless, it will be understood that various modifications may be made without departing from the spirit and scope of the invention. For example, the inside of the heat chamber 207 may be lined with a heat reflective material. In addition the inner and outer shapes and measurements of the oven attachment 200 may be altered as desired to adapt the invention to particular light sources 100, or to control the maximum attainable temperature, or to accommodate restorations of various shapes and sizes. Also, the heat chamber 207 may be shaped such that the inside diameter is greater toward the rear of the heat chamber 207. Furthermore, a variety of alternative means to retain the oven attachment 200 to the light source may be contemplated without departing from the spirit of the invention. Accordingly, it is to be understood that the invention is not to be limited by the specific illustrated embodiment, but only by the scope of the appended claims.

We claim:

1. An oven attachment for heat-curing resin compounds used in conjunction with, and mated to, a light curing unit, the oven attachment including a body having a distal end and a proximal end, the proximal end having a generally concave heat chamber defined therein, and being sized and adapted to attach to the light curing unit and to allow a light-cured resin compound to be cured by both heat and light curing concurrently using the light curing unit to provide both a light source and a heat source.

2. The oven attachment of claim 1, wherein the light curing unit has a retention device, and the oven attachment further includes an engagement means in a wall of the oven attachment for engaging the retention device.

3. The oven attachment of claim 2, wherein the retention device of the light curing unit has a head, and the body of the oven attachment has a notch means for accepting the head of the retention device.

4. The oven attachment means of claim 1, further including a thermometer means coupled to the body for indicating the temperature within the oven attachment.

5. The oven attachment means of claim 1, wherein the body of the oven attachment comprises a thermally insulating material.

6. The oven attachment means of claim 1, further including an insulating material applied to at least a portion of the body for protection of a user.

7. An oven system for heat-curing resin compounds, including:

a. a light curing unit;

b. an oven attachment having a body with a distal end and a proximal end, the proximal end having a generally concave heat chamber defined therein, and being sized and adapted to attach to the light curing unit and which allows a light-cured resin compound to be cured by both heat and light curing concurrently using the light curing unit to provide both a light source and a heat source.

8. The oven system of claim 7, wherein the oven attachment further includes a thermometer means coupled to the body of the oven attachment for indicating the temperature within the oven attachment.

9. The oven system of claim 7, wherein the oven attachment further includes a an insulating material applied to at least a portion of the body of the oven attachment for protection of a user.

10. The oven system of claim 9, wherein the light curing unit includes a retention device, and the oven attachment further includes an engagement means in a wall for engaging the retention device.

11. The oven system of claim 10, wherein the retention device has a head, and the oven attachment further includes a notch for accepting the head of the retention device.

12. A method for heat-curing a light-cured resin compound, including the steps of:

a. providing an oven attachment having a body having a proximal end and a distal end, the proximal end having a heat chamber defined therein, and being adapted to attach to a light source;

b. placing a heat curable resin structure within the heat chamber;

c. attaching the oven attachment to the light source;

d. directing light from the light source into the heat chamber for a selected period of time, thereby elevating the temperature of the heating chamber to a desired level.

* * * * *